US008712258B2

(12) United States Patent
Muranaka

(10) Patent No.: US 8,712,258 B2
(45) Date of Patent: Apr. 29, 2014

(54) IMAGE PROCESSING APPARATUS CAPABLE OF USING REPLACEMENT COMPONENT, IMAGE FORMING APPARATUS CAPABLE OF USING REPLACEMENT COMPONENT, AND METHOD OF ADMINISTRATING REPLACEMENT COMPONENT

(75) Inventor: Nobuyuki Muranaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 250 days.

(21) Appl. No.: 12/950,428

(22) Filed: Nov. 19, 2010

(65) Prior Publication Data

US 2011/0129238 A1 Jun. 2, 2011

(30) Foreign Application Priority Data

Nov. 27, 2009 (JP) ..... 2009-269757

(51) Int. Cl.
*G03G 15/00* (2006.01)

(52) U.S. Cl.
USPC ..... 399/12

(58) Field of Classification Search
USPC ..... 399/12, 13, 24, 80
See application file for complete search history.

(56) References Cited

U.S. PATENT DOCUMENTS

| | | | | |
|---|---|---|---|---|
| 6,488,352 | B1 * | 12/2002 | Helterline et al. | 347/19 |
| 2005/0244169 | A1 * | 11/2005 | Ono | 399/12 |
| 2007/0279647 | A1 | 12/2007 | Shinyama | |
| 2008/0240745 | A1 * | 10/2008 | Hibino | 399/24 |
| 2008/0279568 | A1 * | 11/2008 | Sugiura | 399/12 |

FOREIGN PATENT DOCUMENTS

| | | |
|---|---|---|
| CN | 101063867 | 10/2007 |
| EP | 1850190 | 10/2007 |
| JP | 2002-333800 A | 11/2002 |
| JP | 2007-292992 | 11/2007 |

* cited by examiner

*Primary Examiner* — Billy Lactaoen
(74) *Attorney, Agent, or Firm* — Kubotera & Associates, LLC

(57) ABSTRACT

An image processing apparatus is capable of using a replacement component. The image processing apparatus includes a storage unit for storing self apparatus identification information; an obtaining unit for obtaining component apparatus identification information registered in a data carrier disposed in the replacement component; and a control unit. The control unit includes a first comparing unit for comparing the self apparatus identification information stored in the storage unit with the component apparatus identification information obtained with the obtaining unit; a determining unit for determining that the replacement component is allowed to use when the self apparatus identification information matches the component apparatus identification information.

15 Claims, 14 Drawing Sheets

18a Status information

| | 18b Unit number | 18c Apparatus number | 18d Administrator ID |
|---|---|---|---|
| 11 | S/N T079463 | S/N P208512 | 2d6hiy#s |

FIG. 5

19a

| Apparatus number |
|---|
| S/N P208512 |

FIG. 6

19a 19b

| Apparatus number | Common group apparatus number | | |
|---|---|---|---|
| S/N P208512 | S/N P208513 | S/N P215870 | ••• |

FIG. 10

19a 19c Group identification mark

| Apparatus number | |
|---|---|
| S/N P208512 | s6jg $ 2iv |

FIG. 13

18a Status information

| | 18b Unit number | 18c Apparatus number | 18d Administrator ID | 18e Group information | 18f Group identification mark |
|---|---|---|---|---|---|
| 11 | S/N T079463 | S/N P208512 | 2d6hiy#s | 1 | s6jg $ 2iv |

FIG. 14

IMAGE PROCESSING APPARATUS CAPABLE OF USING REPLACEMENT COMPONENT, IMAGE FORMING APPARATUS CAPABLE OF USING REPLACEMENT COMPONENT, AND METHOD OF ADMINISTRATING REPLACEMENT COMPONENT

BACKGROUND OF THE INVENTION AND RELATED ART STATEMENT

The present invention relates to an image processing apparatus, an image forming apparatus, and a method of administrating or using a replacement component.

In a conventional image forming apparatus such as a printer, a facsimile, a copier, and an MFP (a multi function peripheral or product), a replacement component (or a replacement unit) such as a drum cartridge, a toner cartridge, and the like is detachably attached to a main body of the conventional image forming apparatus or an apparatus main body thereof.

In general, a manufacture of an image forming apparatus designs a configuration of the image forming apparatus assuming that a replacement component attached to the image forming apparatus is an authentic component or a certified component. Accordingly, when a counterfeit component or a modified component is attached to the image forming apparatus, there may be a risk of deteriorating an image or malfunction. To this end, there has been proposed a conventional technology, in which a tag or a memory indicating authenticity is disposed in the replacement component, so that a counterfeit component or a modified component is not allowed to attach to the image forming apparatus (refer to Patent Reference).

Patent Reference: Japanese Patent Publication No. 2007-292992

In the conventional technology, when a plurality of image forming apparatus is the same type, it is possible to attach a replacement component to all of the image forming apparatus. Accordingly, it is difficult to administer a usage frequency of the replacement component per each image forming apparatus.

In view of the problems described above, an object of the present invention is to provide an image processing apparatus, an image forming apparatus, and a method of administrating or using a replacement component capable of solving the problems of the conventional technology. In the present invention, it is possible to allow the replacement component to be used only in a designated image forming apparatus even when a plurality of image forming apparatus is the same type.

Further objects and advantages of the invention will be apparent from the following description of the invention.

SUMMARY OF THE INVENTION

In order to attain the objects described above, according to a first aspect of the present invention, an image processing apparatus is capable of using a replacement component.

The image processing apparatus includes a storage unit for storing self apparatus identification information; an obtaining unit for obtaining component apparatus identification information registered in a data carrier disposed in the replacement component; and a control unit. The control unit includes a first comparing unit for comparing the self apparatus identification information stored in the storage unit with the component apparatus identification information obtained with the obtaining unit; and a determining unit for determining that the replacement component is allowed to use when the self apparatus identification information matches the component apparatus identification information.

According to a second aspect of the present invention, an image forming apparatus includes the image processing apparatus described above and the replacement component. Further, the image forming apparatus includes an image forming unit for forming an image on a medium when the determining unit determines that the replacement component is allowed to use.

According to a third aspect of the present invention, a method of administrating or using a replacement component of an image processing apparatus is to be executed with a control unit of the image processing apparatus capable of using the replacement component. The method includes the steps of storing self apparatus identification information in a storage unit; obtaining component apparatus identification information registered in a data carrier disposed in the replacement component using an obtaining unit; comparing the self apparatus identification information stored in the storage unit with the component apparatus identification information obtained with the obtaining unit; and determining that the replacement component is allowed to use when the self apparatus identification information matches the component apparatus identification information.

In the present invention, it is possible to allow the replacement component to be used only in a designated image forming apparatus.

BRIEF DESCRIPTION OF THE DRAWINGS

FIG. 5 is a schematic view showing a data configuration of an RFID tag of the image forming apparatus according to the first embodiment of the present invention;

FIG. 6 is a schematic view showing a data configuration of the image forming apparatus according to the first embodiment of the present invention;

FIG. 10 is a schematic view showing a data configuration of the image forming apparatus according to the second embodiment of the present invention;

FIG. 13 is a schematic view showing a data configuration of the image forming apparatus according to the third embodiment of the present invention;

FIG. 14 is a schematic view showing a data configuration of an RFID tag of the image forming apparatus according to the third embodiment of the present invention;

DETAILED DESCRIPTION OF PREFERRED EMBODIMENTS

Hereunder, embodiments of the present invention will be explained with reference to the accompanying drawings.

First Embodiment

Figure 1:
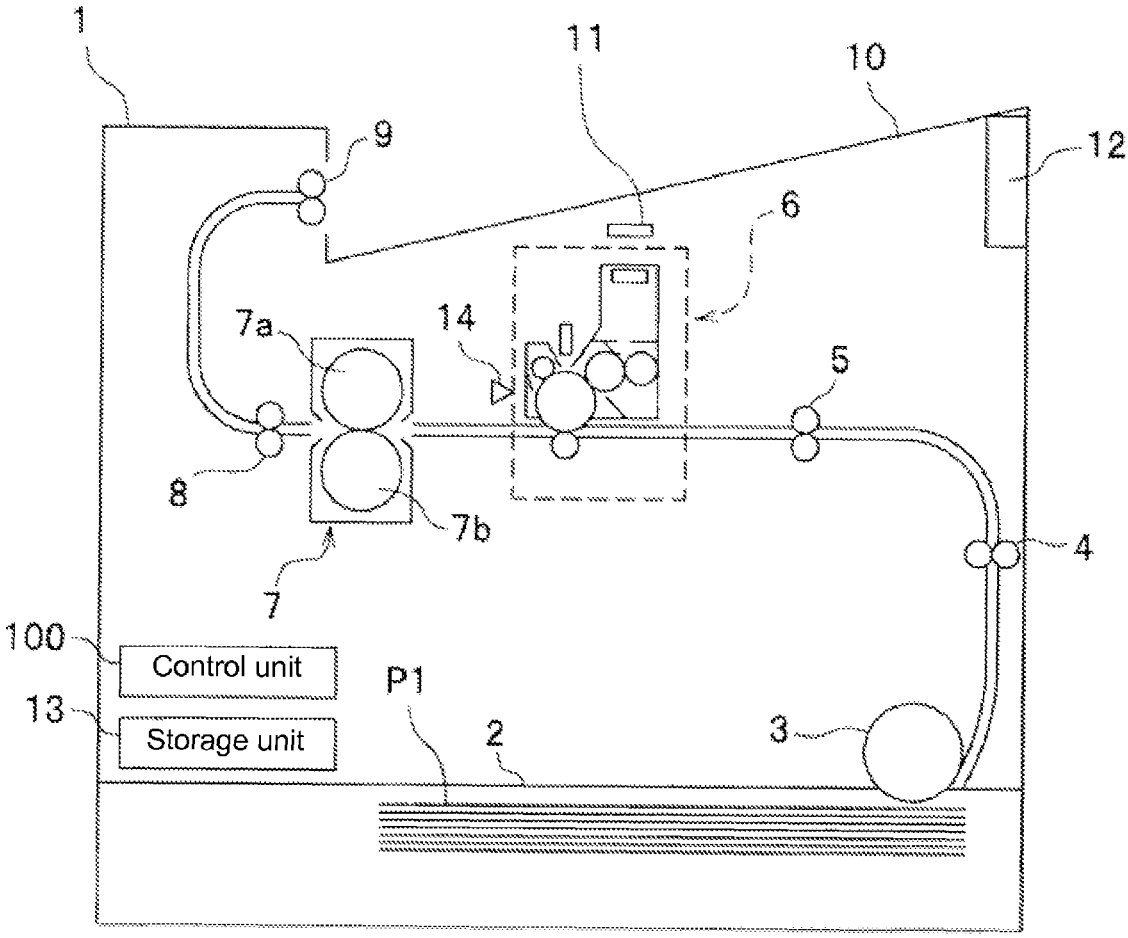
FIG. 1 is a schematic sectional view a configuration of an image forming apparatus according to a first embodiment of the present invention.
Figure 2:
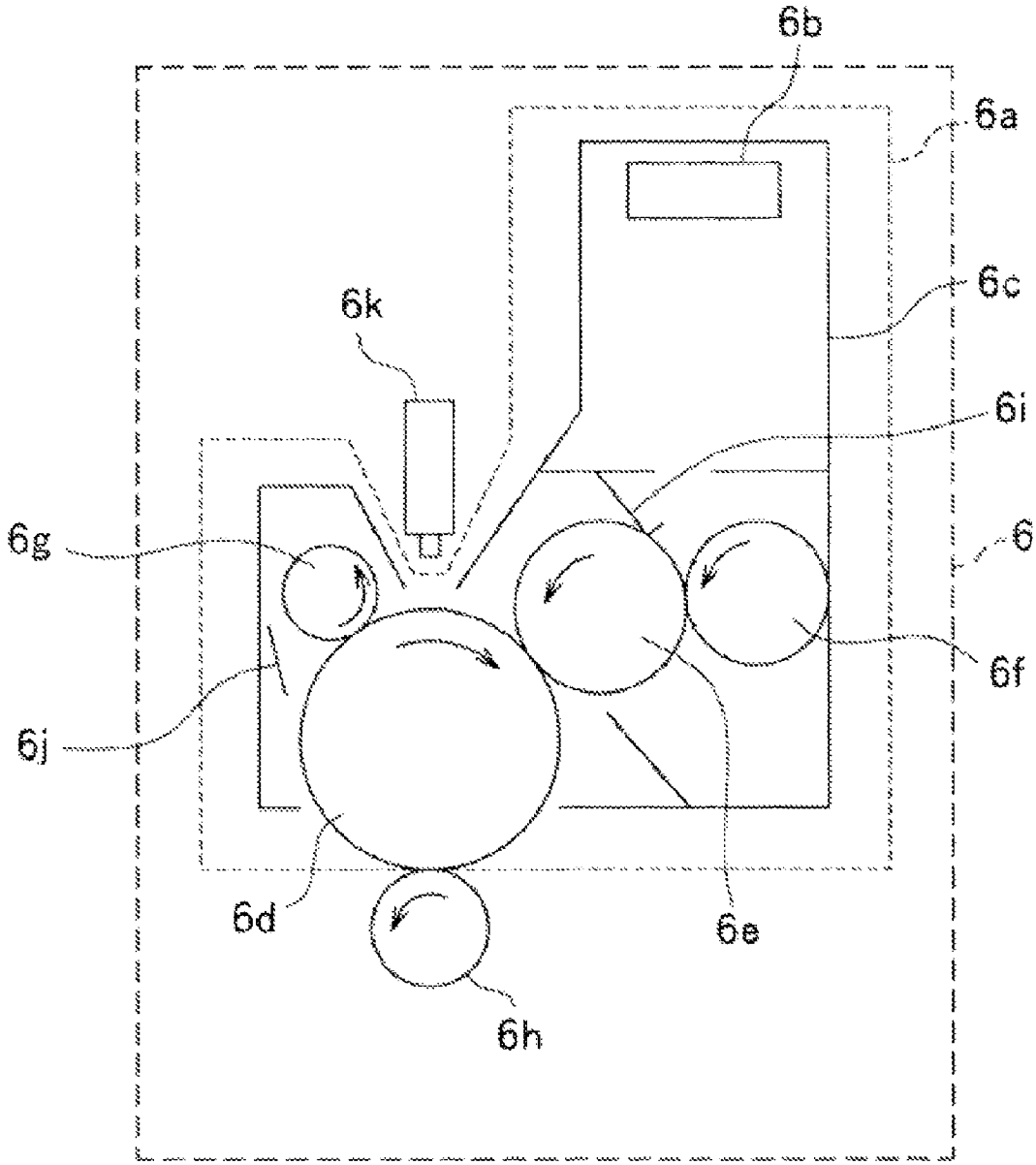
FIG. 2 is a schematic sectional view showing a configuration of an image forming unit of the image forming apparatus according to the first embodiment of the present invention.
Figure 3:
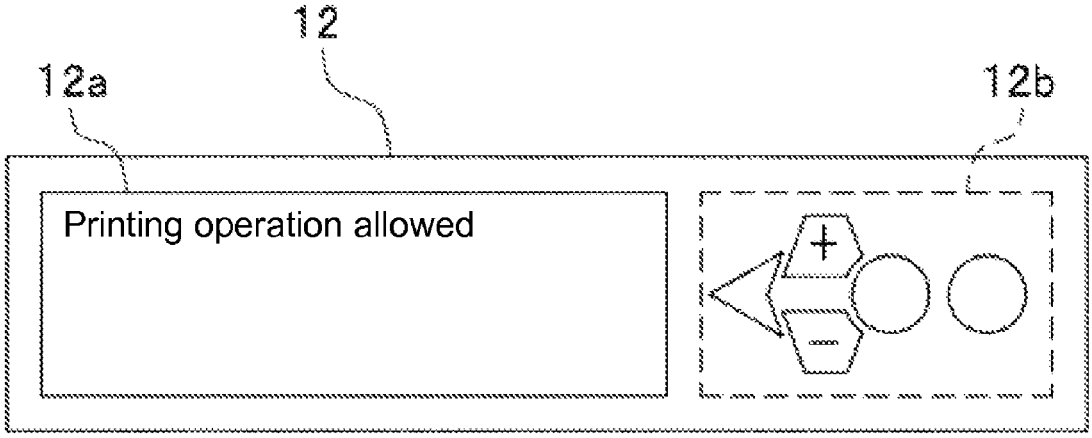
FIG. 3 is a schematic view showing a configuration of an operation panel of the image forming apparatus according to the first embodiment of the present invention.

A first embodiment of the present invention will be explained. FIG. 1 is a schematic sectional view a configuration of an image forming apparatus according to the first embodiment of the present invention. FIG. 2 is a schematic sectional view showing a configuration of an image forming unit 6 of the image forming apparatus according to the first embodiment of the present invention. FIG. 3 is a schematic view showing a configuration of an operation panel 12 of the image forming apparatus according to the first embodiment of the present invention.

First, a configuration of a printer 1 as the image forming apparatus will be explained with reference to FIGS. 1 to 3. As shown in FIG. 1, the printer 1 as the image forming apparatus includes an image forming unit 6; a fixing unit 7; a transportation mechanism (a sheet supply roller 3, transportation rollers 4 and 5, and discharge rollers 8 and 9); an RFID (Radio Frequency Identification) reader writer 11; an operation panel 12; a storage unit 13; a sensor 14; and a control unit 100.

In the embodiment, the printer 1 further includes a sheet supply cassette 2 for storing a medium P1 such as a printing sheet and the like. The sheet supply roller 3 is provided for picking up the medium P1 from the sheet supply cassette 2 one by one. The transportation rollers 4 and 5 are provided for supplying the medium P1 picked up from the sheet supply roller 3 to the image forming unit 6.

In the embodiment, the image forming unit 6 is provided for forming an image on the medium P1. As shown in FIG. 2, the image forming unit 6 includes an image drum cartridge 6*a* as a replacement component (or a replacement unit).

Next, a configuration of the image forming unit 6 will be explained with reference to FIG. 2. As shown in FIG. 2, the image forming unit 6 is formed of the image drum cartridge 6*a*; an LED (Light Emitting Diode) head 6*k*, and a transfer drum 6*h*.

In the embodiment, as an example of the replacement component, the image drum cartridge 6*a* is explained, and the replacement component is not limited to the image drum cartridge 6*a*. The present invention is applicable to other replacement components (a modified example of the replacement component will be explained later).

In the embodiment, the image drum cartridge 6*a* as the replacement component is formed of a toner storage portion 6*c* for retaining toner; a printing drum (photosensitive drum) 6*d* for forming a static latent image with the LED head 6*k*; a developing roller 6*e* for visualizing the static latent image as a toner image on the printing drum 6*d*; a supply roller 6*f* for supplying toner retained in the toner storage portion 6*c* to the developing roller 6*e*; and a charging roller 6*g* for charging the printing drum 6*d*.

Further, the image drum cartridge 6*a* includes a developing blade 6*i* for forming a thin layer of toner supplied to the developing roller 6*e*; and a cleaning blade 6*j* for scraping off toner not transferred and remaining on the printing drum 6*d* to collect toner.

In the embodiment, the image drum cartridge 6*a* as the replacement component is further provided with an RFID (Radio Frequency Identification) tag 6*d* as a data carrier. The RFID tag 6*b* is provided for storing various types of information of the image drum cartridge 6*a*. The RFID tag 6*b* is formed of, for example, a control circuit, a memory circuit, an antenna, and the like (not shown).

In the embodiment, the LED head 6*k* is formed of a plurality of LEDs arranged linearly. The LEDs selectively emit light according to a printing pattern, so that the LED head 6*k* exposes a surface of the printing drum 6*d*, thereby forming the static latent image thereon. The transfer drum 6*h* is provided for transferring the toner image formed on the printing drum (the photosensitive drum) 6*d* to the medium P1.

In the embodiment, the printing drum (the photosensitive drum) 6*d*, the developing roller 6*f*, the supply roller 6*f*, the charging roller 6*g* and the transfer drum 6*h* are arranged to rotate in arrow directions shown in FIG. 2, respectively.

As shown in FIG. 1, the fixing unit 7 includes a heating roller 7*a* and a fixing roller 7*b* arranged to face each other, so that the fixing unit 7 heats and presses the toner image transferred to the medium P1, thereby fixing the toner image to the medium P1. The discharge rollers 8 and 9 are provided for discharging the medium P1 to a discharge tray 10 after the fixing unit 7 fixes the toner image to the medium P1.

In the embodiment, the RFID (Radio Frequency Identification) read writer 11 is provided as an obtaining unit for reading information stored in the RFID tag 6*b* (refer to FIG. 2) disposed in the image drum cartridge 6*a* (refer to FIG. 2), and for writing information into the RFID tag 6*b*. The RFID reader writer 11 is formed of, for example, a control circuit, an antenna, and the like (not shown).

In the embodiment, the operation panel 12 is provided as an input unit for displaying a status of the printer 1 and inputting various settings. FIG. 3 is a schematic view showing the configuration of the operation panel 12. As shown in FIG. 3, the operation panel 12 includes a display portion 12*a* formed of an LCD panel for displaying a status of the printer 1 and the like. Further, the operation panel 12 includes an operation button 12*b* for inputting various settings of the printer 1, an administrator ID (described later), and the like.

In the embodiment, the storage unit 13 shown in FIG. 1 is formed of a non-volatile memory and the like. The storage unit 13 is provided for storing, for example, a control program executed with the control unit 100, printing data, various types of information of the printer 1, and the like.

In the embodiment, the sensor 14 is provided for detecting whether the image drum cartridge 6*a* as the replacement component is attached to the printer 1. More specifically, the sensor 14 detects the image drum cartridge 6*a* through, for example, a mechanical response thereof.

In the embodiment, the control unit 100 shown in FIG. 1 is formed of a microprocessor, a peripheral circuit, and the like (not shown). In the control unit 100, the micro processor executes the control program stored in the storage unit 13, so that the control unit 100 realizes various functions for controlling the printer 1.

Figure 4:
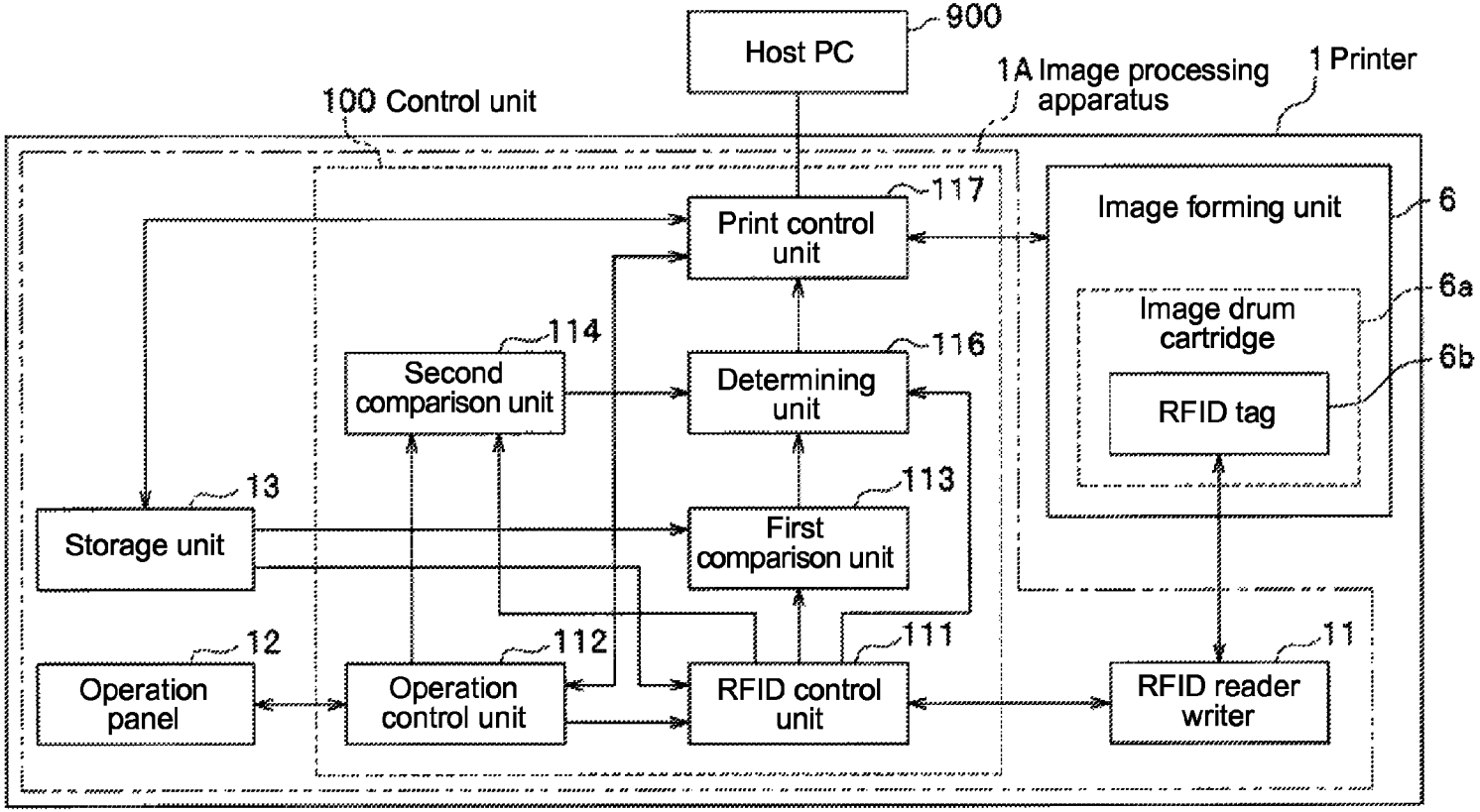
FIG. 4 is a block diagram showing functional components of the image forming apparatus according to the first embodiment of the present invention.

FIG. 4 is a block diagram showing functional components of the image forming apparatus according to the first embodiment of the present invention. FIG. 5 is a schematic view showing a data configuration of the RFID tag 6*b* of the image forming apparatus according to the first embodiment of the present invention. FIG. 6 is a schematic view showing a data configuration of the image forming apparatus according to the first embodiment of the present invention.

In the following description, the data configurations of the RFID tag 6*b* and the storage unit 13 will be explained with reference to FIGS. 5 and 6. Then, functions of the printer 1 as the image forming apparatus will be explained with reference to FIG. 4. The components explained with reference to FIGS. 1 to 3 are designated with the same reference numerals.

FIG. 5 is a schematic view showing the data configuration of the RFID tag 6*b*. As shown in FIG. 5, the RFID tag 6*b* includes a status information column 18*a* for storing status information of the image drum cartridge 6*a* (refer to FIG. 2).

More specifically, when the status information of the image drum cartridge 6*a* is "00" in the status information column 18*a*, it is indicated that the image drum cartridge 6*a* is a brand-new one, and is not attached to the printer 1. When the status information of the image drum cartridge 6*a* is "10" in the status information column 18*a*, it is indicated that the image drum cartridge 6*a* is attached to the printer 1 once, but the administration ID thereof is not registered. When the status information of the image drum cartridge 6*a* is "11" in the status information column 18*a*, it is indicated that the image drum cartridge 6*a* is attached to the printer 1 once, and the administration ID thereof is registered.

In the embodiment, when the image drum cartridge 6*a* is a brand-new one, a manufacturer thereof sets the value "00" in the status information column 18*a*. In the following description, it is supposed that the manufacturer of the image drum cartridge 6*a* sets the value "00" in the status information column 18*a* during a manufacturing process, and delivers the image drum cartridge 6*a*.

As shown in FIG. 5, the RFID tag 6*b* further includes a unit number column 18*b* for storing a unit number unique to each image drum cartridge 6*a*. More specifically, the manufacturer of the image drum cartridge 6*a* may set a serial number assigned to the image drum cartridge 6*a* in the manufacturing process as the unit number in the unit number column 18*b*. The RFID tag 6*b* further includes an apparatus number column 18*c* for storing an apparatus number of the printer 1. When the image drum cartridge 6*a* is attached to the printer 1 for the first time, the apparatus number is stored in the apparatus number column 18*c* as component apparatus identification information unique to the printer 1. The apparatus number stored in the apparatus number column 18*c* has a data format the same as that of an apparatus number stored in the storage unit 13 (described later).

In the embodiment, the RFID tag 6*b* further includes an administrator ID column 18*d* for storing the administrator ID as component administrator identification information unique to each administrator. More specifically, an arbitrary number such as an employee number may be set as the administrator ID in the administrator ID column 18*d*.

FIG. 6 is a schematic view showing the data configuration of the storage unit 13. As shown in FIG. 6, the storage unit 13 includes an apparatus number column 19*a* for storing the apparatus number as self apparatus identification information unique to each image forming apparatus. More specifically, a manufacturer of the printer 1 may set a serial number assigned to the printer 1 in a manufacturing process as the apparatus number in the apparatus number column 19*a*.

FIG. 4 is a block diagram showing functional components of the printer 1 as the image forming apparatus according to the first embodiment of the present invention. As shown in FIG. 4, the printer 1 includes an image processing apparatus 1A, so that the image processing apparatus 1A realizes each of specific functions. When the microprocessor of the control unit 100 (not shown) executes the control programs stored in the storage unit 13, functions of units disposed in the control unit 100 are realized.

In the following description, the units of the control unit 100 will be explained in detail in cases that the image drum cartridge 6*a* as the replacement component is attached to the printer 1 as the image forming apparatus according to the first embodiment, and that the administration ID is registered in the image drum cartridge 6*a* as the replacement component through the printer 1 as the image forming apparatus according to the first embodiment.

In the embodiment, the control unit 100 includes an RFID control unit 111. In the case that the image drum cartridge 6*a* as the replacement component is attached to the printer 1 as the image forming apparatus according to the first embodiment, the RFID control unit 111 writes data in the RFID tag 6*b* through the RFID reader writer 11. More specifically, when the image drum cartridge 6*a* is a brand-new one, and is not attached to the printer 1, the RFID control unit 111 writes the apparatus number stored in the storage unit 13 (in the apparatus number column 19*a*) in the apparatus number column 18*c* of the RFID tag 6*b*, and writes "10" in the status information column 18*a* of the RFID tag 6*b* through the RFID reader writer 11.

Further, the RFID control unit 111 reads the data stored in the RFID tag 6*b* (refer to FIG. 5) through the RFID reader writer 11, and transmits the data thus read to each of the units. More specifically, the control unit 100 includes a determining unit 116. When the image drum cartridge 6*a* as the replacement component is attached, the RFID control unit 111 reads the data stored in the RFID tag 6*b* immediately, and transmits the status information (in the status information column 18*a*) to the determining unit 116.

In the embodiment, the control unit 100 includes a first comparison unit 113 and a second comparison unit 114. When the RFID control unit 111 determines whether the apparatus number is identical, the RFID control unit 111 transmits the apparatus number (in the apparatus number column 18*c*) to the first comparison unit 113. When the RFID control unit 111 determines whether the administrator is identical, the RFID control unit 111 transmits the administrator ID (in the administrator ID column 18*d*) to the second comparison unit 114.

In the embodiment, the control unit 100 includes an operation control unit 112 for transmitting information input by an operator through the operation panel 12 to each unit. Further, the operation control unit 112 is provided for displaying various types of information on the operation panel 12. More specifically, when the operation control unit 112 receives a notification that a printing operation cannot be performed from the determining unit 116, the operation control unit 112 displays that the printing operation cannot be performed on the operation panel 12*a* (refer to FIG. 3). Further, when it is determined whether the administrator is identical, the operation control unit 112 displays a screen for prompting an input of the administrator ID as the self apparatus identification information on the operation panel 12*a*, and transmits the administrator ID thus input to the second comparison unit 114.

In the embodiment, the control unit 100 includes a print control unit 117. When the operator inputs information related to the print setting and the like, the RFID control unit 111 transmits the information thus input to the print control unit 117.

In the embodiment, the first comparison unit 113 is provided for determining whether the image drum cartridge 6*a* as the replacement component is attached again to the image forming apparatus to which the image drum cartridge 6*a* was attached before. More specifically, the first comparison unit 113 is provided for comparing the apparatus number stored in the RFID tag 6*b* (in the apparatus number column 18*c*) received from the RFID control unit 111 with the apparatus number stored in the storage unit 13 (in the apparatus number column 19*a*). Then, the first comparison unit 113 transmits a comparison result to the determining unit 116.

In the embodiment, the second comparison unit 114 is provided for determining whether the administrator is identical. More specifically, the second comparison unit 114 is provided for comparing the administrator ID stored in the RFID tag 6*b* (in the administrator ID column 18*d*) received from the RFID control unit 111 with the administrator ID received from the operation control unit 112. Then, the second comparison unit 114 transmits a comparison result to the determining unit 116.

In the embodiment, the determining unit 116 is provided for determining whether the print control unit 117 is allowed to perform a printing operation according to the status information of the image drum cartridge 6*a* as the replacement component, the comparison result of the first comparison unit 113, and the comparison result of the second comparison unit 114. Then, the determining unit 116 transmits a determination result to the print control unit 117 and the operation control unit 112.

More specifically, when the status information stored in the RFID tag 6*b* (in the status information column 18*a*) received from the RFID control unit 111 is "00", that is, the image drum cartridge 6*a* is a brand-new one and is not attached to the printer 1, the determining unit 116 allows the print control unit 117 to perform the printing operation. Further, when the status information (in the status information column 18*a*) is "10" or "11", and the comparison result received from the first comparison unit 113 is matched, the determining unit 116 allows the print control unit 117 to perform the printing operation. Further, when the status information (in the status information column 18*a*) is "11", and the comparison result received from the second comparison unit 114 is matched, the determining unit 116 allows the print control unit 117 to perform the printing operation. Otherwise, the determining unit 116 does not allow the print control unit 117 to perform the printing operation.

In the case that the administration ID is registered in the image drum cartridge 6*a* as the replacement component through the printer 1 as the image forming apparatus according to the first embodiment, when the administration ID is registered, the RFID control unit 111 reads the data stored in the RFID tag 6*b* through the RFID reader writer 11, and transmits the apparatus status (in the status information column 18*a*) to the determining unit 116. Further, the RFID control unit 111 writes the administration ID input through the operation panel 12 in the administrator ID column 18*d* of the RFID tag 6*b* through the RFID reader writer 11.

In the embodiment, the operation control unit 112 is provided for displaying the screen for prompting the input of the administrator ID on the operation panel 12*a*, and transmits the administrator ID input through the operation panel 12 to the RFID control unit 111.

In the embodiment, the determining unit 116 is provided for determining whether the administrator ID can be written in the administrator ID column 18*d* of the RFID tag 6*b* according to the status information of the image drum cartridge 6*a*. Then, the determining unit 116 transmits a determination result to the operation control unit 112 and the RFID control unit 111. More specifically, when the status information stored in the RFID tag 6*b* (in the status information column 18*a*) received from the RFID control unit 111 is "10" (the administrator ID is not registered), the determining unit 116 allows the administrator ID to be written in the RFID tag 6*b*. When the status information is "11" (the administrator ID is already registered), the determining unit 116 does not allow the administrator ID to be written in the RFID tag 6*b*.

The printing operation of the printer 1 as the image forming apparatus according to the first embodiment will be explained next with reference to FIGS. 1 to 4. When the printer 1 receives image forming information from a host PC 900 (refer to FIG. 4), the print control unit 117 drives the sheet supply roller 3 to pick up the medium P1 from the sheet supply cassette 2, and drives the transportation rollers 4 and 5 to transport the medium P1 to the image forming unit 6.

In the next step, the print control unit 117 controls the image forming unit 6 to transfer the toner image to the medium P1, and transports the medium P1 with the toner image transferred thereon to the fixing unit 7. In the next step, the print control unit 117 controls the fixing unit 7 to fix the toner image to the medium P1 with the heating roller 7*a* and the fixing roller 7*b*. In the next step, the print control unit 117 drives the discharge rollers 8 and 9 to discharge the medium P1 on the discharge tray 10. Through the steps described above, the printing operation is complete.

Figure 7:
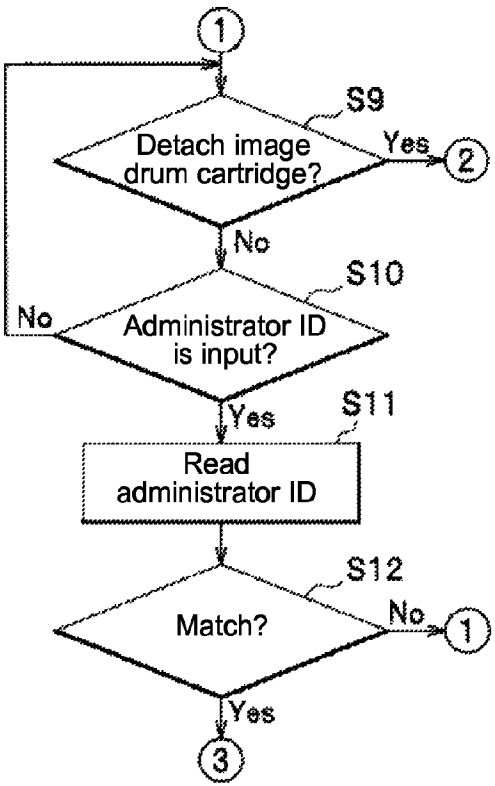
FIG. 7 is a flow chart showing an operation of the image forming apparatus when a replacement component is attached to the image forming apparatus according to the first embodiment of the present invention.
Figure 7:
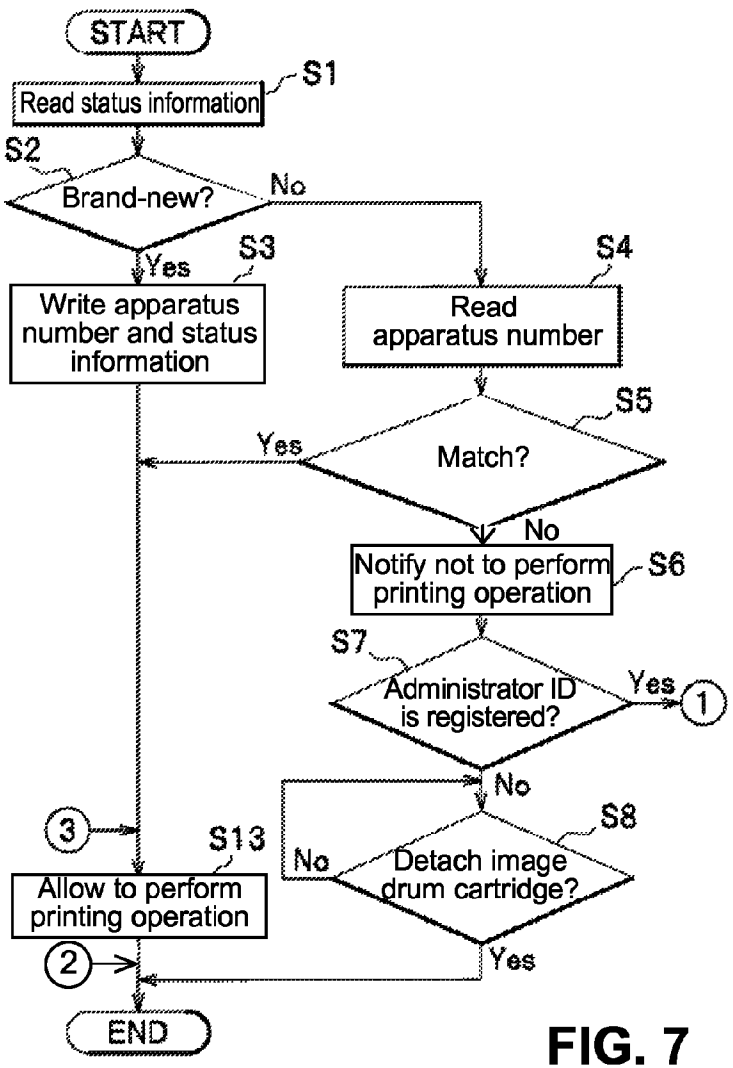

An operation of the printer 1 when the replacement component is attached to the printer 1 will be explained next with reference to FIG. 7. FIG. 7 is a flow chart showing the operation of the image forming apparatus when the replacement component is attached to the image forming apparatus according to the first embodiment of the present invention.

In the embodiment, when the operator attaches the image drum cartridge 6*a* as the replacement component to the printer 1, the sensor 14 detects that the image drum cartridge 6*a* is attached to the printer 1, and the image processing apparatus 1A starts an operation as follows.

In step S1, the RFID control unit 111 reads the status information stored in the RFID tag 6*b* (in the status information column 18*a*) through the RFID reader writer 11, and transmits the status information to the determining unit 116. In step S2, the determining unit 116 determines whether the status information stored in the RFID tag 6*b* (in the status information column 18*a*) received from the RFID control unit 111 is "00", that is, the image drum cartridge 6*a* is a brand-new one and is not attached to the printer 1. When the determining unit 116 determines that the image drum cartridge 6*a* is a brand-new one, the process proceeds to step S3. When the determining unit 116 determines that the image drum cartridge 6*a* is not a brand-new one, the process proceeds to step S4.

In step S3, when the determining unit 116 determines that the image drum cartridge 6*a* is a brand-new one (step S2, Yes), the RFID control unit 111 writes the apparatus number stored in the storage unit 13 (in the apparatus number column 19*a*) in the apparatus number column 18*c* of the RFID tag 6*b*. Further, the RFID control unit 111 writes "10" in the status information column 18*a* of the RFID tag 6*b*. Then the process proceeds to step S13.

In step S4, when the determining unit 116 determines that the image drum cartridge 6*a* is not a brand-new one (step S2, No), the RFID control unit 111 reads the apparatus number stored in the RFID tag 6*b* (in the apparatus number column 18*c*) through the RFID reader writer 11, and transmits the apparatus number to the first comparison unit 113. In step S5, the first comparison unit 113 compares the apparatus number (in the apparatus number column 18*c*) received from the RFID control unit 111 in step S4 with the apparatus number stored in the storage unit 13 (in the apparatus number column 19*a*). Then, the first comparison unit 113 transmits the comparison result to the determining unit 116. When the determining unit 116 determines that the comparison result is matched, the process proceeds to step S13. When the determining unit 116 determines that the comparison result is not matched, the process proceeds to step S6.

In step S6, when the determining unit 116 determines that the comparison result is not matched (step S5, No), the determining unit 116 notifies the print control unit 117 not to perform the printing operation. Further, the determining unit 116 notifies the operation control unit 112 that the printing operation cannot be performed. Accordingly, the operation control unit 112 displays that the printing operation cannot be performed on the operation panel 12*a* (refer to FIG. 3), thereby notifying the operator.

In step S7, when the status information stored in the RFID tag 6*b* (in the status information column 18*a*) received from the RFID control unit 111 is "10", the determining unit 116 determines that the administrator ID is not registered, and the process proceeds to step S8. When the status information stored in the RFID tag 6*b* (in the status information column 18*a*) received from the RFID control unit 111 is "11", the determining unit 116 determines that the administrator ID is registered in the image drum cartridge 6*a*, and the process proceeds to step S9.

In step S8, when the determining unit 116 determines that the administrator ID is not registered in the image drum cartridge 6*a* (step S7, No), the print control unit 117 waits until the image drum cartridge 6*a* is detached from the printer 1. When the image drum cartridge 6*a* is detached from the printer 1, the sensor 14 detects that the image drum cartridge 6*a* is detached from the printer 1, and notifies the print control unit 117. When the image drum cartridge 6*a* is detached from the printer 1, the process is completed.

In step S9, when the determining unit 116 determines that the administrator ID is registered in the image drum cartridge 6*a* (step S7, Yes), the print control unit 117 waits until the image drum cartridge 6*a* is detached from the printer 1. In step S10, the print control unit 117 waits until the administrator inputs the administrator ID through the operation panel 12 and the determining unit 116 allows the print control unit 117 to perform the printing operation. When the image drum cartridge 6*a* is detached from the printer 1, the process is completed. When the administrator ID is input, the operation control unit 112 notifies the administrator ID thus input to the RFID control unit 111 and the second comparison unit 114.

In step S11, when the administrator ID is input in step S10 (step S10, Yes), the RFID control unit 111 reads the administrator ID stored in the RFID tag 6*b* (in the administrator ID column 18*d*) through the RFID reader writer 11, and transmits the administrator ID to the second comparison unit 114.

In step S12, the second comparison unit 114 compares the administrator ID (in the administrator ID column 18*d*) received from the RFID control unit 111 with the administrator ID (input) received from the operation control unit 112. Then, the second comparison unit 114 transmits the comparison result to the determining unit 116. When the determining unit 116 determines that the comparison result is matched, the process proceeds to step S13. When the determining unit 116 determines that the comparison result is not matched, the process returns to step S9, so that step S9 and step S10 are repeated.

In step S13, after step S3, or when the determining unit 116 determines that the comparison result is matched in step S5 or step S12, the determining unit 116 allows the print control unit 117 to perform the printing operation.

Figure 8:
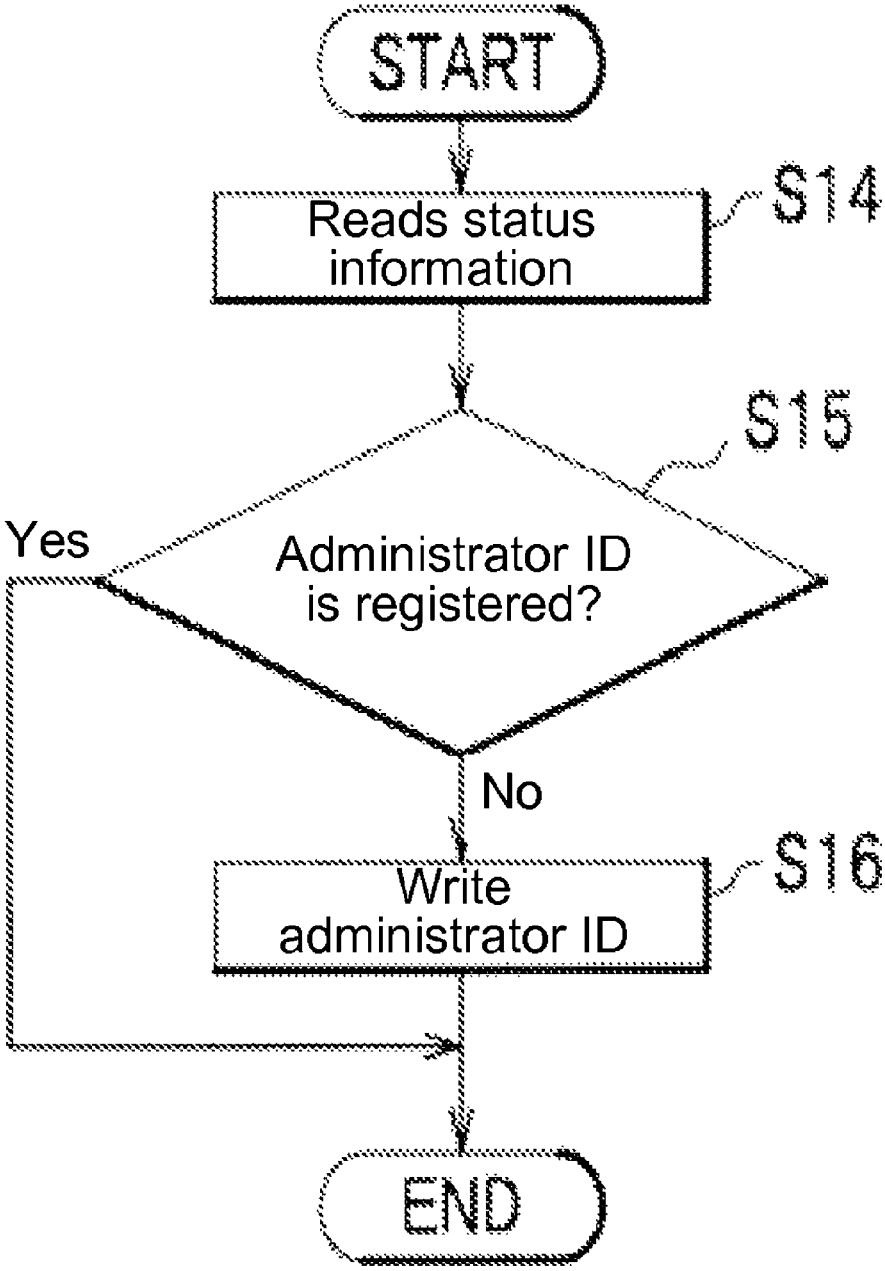
FIG. 8 is a flow chart showing an operation of the image forming apparatus when an administrator ID is registered in the replacement component according to the first embodiment of the present invention.

An operation of the printer 1 when the administrator ID is registered in the replacement component through the image forming apparatus according to the first embodiment will be explained next with reference to FIG. 8. FIG. 8 is a flow chart showing the operation of the image forming apparatus when the administrator ID is registered in the replacement component according to the first embodiment of the present invention.

In the embodiment, in the state that the image drum cartridge 6*a* as the replacement component is attached to the printer 1, when the operator starts the operation for registering the administrator ID, that is, the operator pushes the operation button 12*b*, the image processing apparatus 1A performs the following operation.

In step 14, the RFID control unit 111 reads the status information stored in the status information column 18*a* of the RFID tag 6*b*, and transmits the status information to the determining unit 116.

In step S15, the determining unit 116 determines whether the status information stored (in the status information column 18*a*) received from the RFID control unit 111 is "10", so that the determining unit 116 determines whether the administrator ID is registered in the image drum cartridge 6*a*. When the determining unit 116 determines that the administrator ID is not registered in the image drum cartridge 6*a*, the process proceeds to step S16. When the determining unit 116 determines that the administrator ID is registered in the image drum cartridge 6*a*, the process is completed. In this case, the operation control unit 112 displays a message indicating "the administrator ID is registered" on the operation panel 12*a*.

In step S16, when the determining unit 116 determines that the administrator ID is not registered in the image drum cartridge 6*a* (step S15, No), the operation control unit 112 transmits the administrator ID input by the operator through the operation panel 12 to the RFID control unit 111. In this case, the operation control unit 112 displays a message indicating "Enter the administrator ID" on the operation panel 12*a*. Then, the RFID control unit 111 writes the administrator ID thus received in the administrator ID column 18*d* of the RFID tag 6*b* through the RFID reader writer 11. Further, the RFID control unit 111 updates the apparatus state in the status information column 18*a* to "11", and the process is completed.

As described above, in the embodiment, the image forming apparatus is configured such that the replacement component can be used in only the image forming apparatus to which the replacement component is attached first. Further, with the administrator ID, it is possible to use the replacement component in the image forming apparatus in which the administrator ID is input and matched.

Accordingly, it is possible to avoid the replacement component from being used other apparatus, and to use the replacement component within the controlled range, thereby preventing inconvenience if the replacement component cannot be used in all other apparatus. Further, the administrator can easily manage the usage frequency of the replacement component.

Second Embodiment

A second embodiment of the present invention will be explained next. In the first embodiment, it is possible to administer per each image forming apparatus as compared with a conventional image forming apparatus. When a plurality of image forming apparatus is utilized as a group, however, it is necessary for the administrator to input the administrator ID every time when the replacement component is attached to another image forming apparatus of the group. Accordingly, it is difficult for an ordinary operator to use the replacement component within the group.

In the second embodiment, it is configured such that an identical apparatus number is registered in the image forming apparatus of the group. Accordingly, it is possible for an ordinary operator to use the replacement component within the group.

Figure 9:
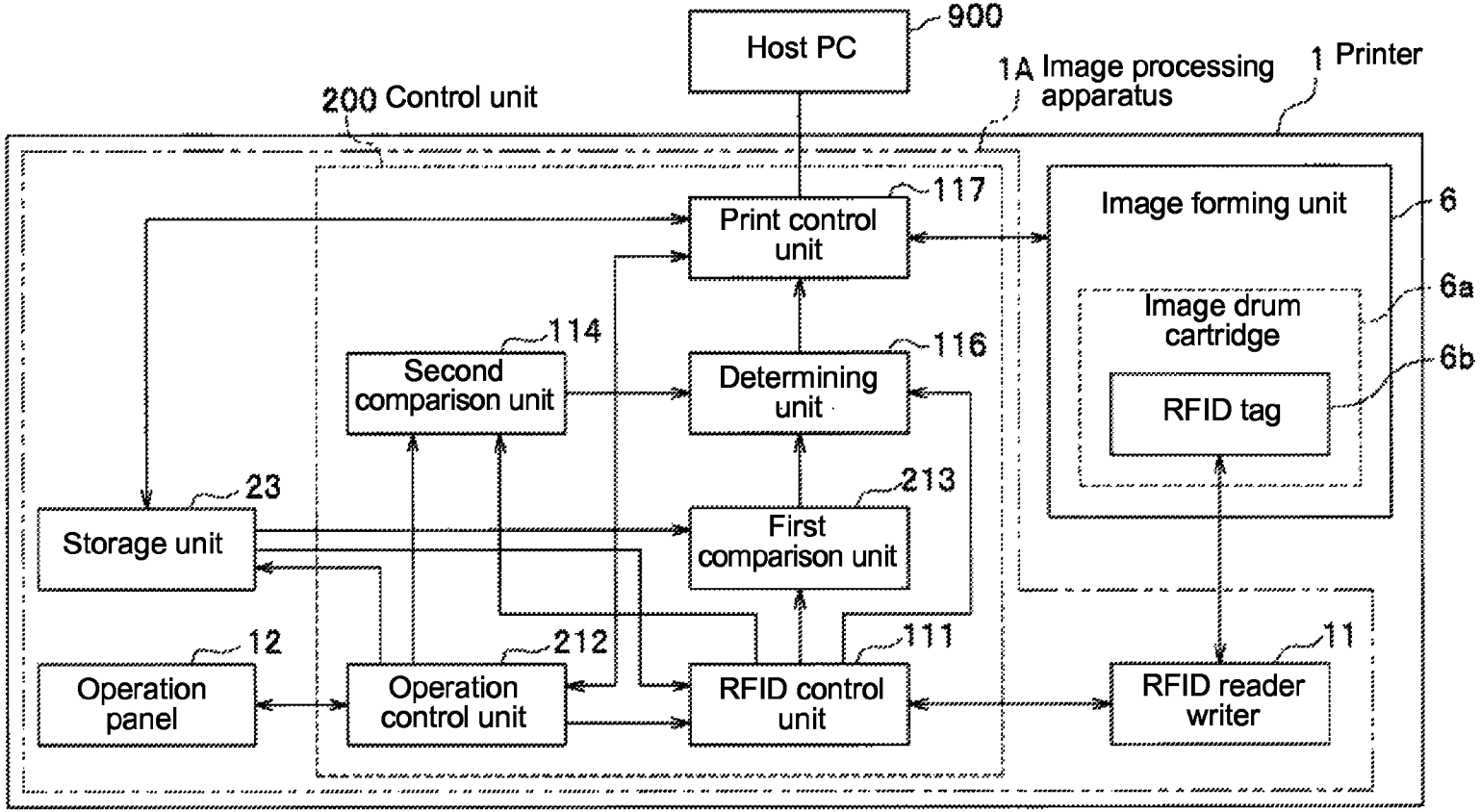
FIG. 9 is a block diagram showing functional components of an image forming apparatus according to a second embodiment of the present invention.

FIG. 9 is a block diagram showing functional components of the image forming apparatus according to the second embodiment of the present invention. FIG. 10 is a schematic view showing a data configuration of the image forming apparatus according to the second embodiment of the present invention.

In the following description, a data configuration of a storage unit 23 will be explained first with reference to FIG. 10. Then, the functional components of the printer 1 as the image forming apparatus will be explained with reference to FIG. 9. Components in the second embodiment similar to those in the first embodiment are designated with the same reference numerals, and only components in the second embodiment different from those in the first embodiment will be explained.

As described above, FIG. 10 is a schematic view showing the data configuration of the storage unit 23. As shown in FIG. 10, the data configuration of the storage unit 23 includes an apparatus number column 19*a*, and information similar to that in the first embodiment is stored in the apparatus number column 19*a*. Further, the data configuration of the storage unit 23 includes a common group apparatus number column 19*b*, and apparatus numbers of the printers are stored in the common group apparatus number column 19*b* as other apparatus identification information. It is possible to store a plurality of apparatus numbers of the printers in the common group apparatus number column 19*b*.

As described above, FIG. 9 is a block diagram showing the functional components of the printer 1 as the image forming apparatus according to the second embodiment of the present invention. As shown in FIG. 9, the printer 1 includes a control unit 200. When a microprocessor of the control unit 200 (not shown) executes a control program stored in the storage unit 23, functions of units disposed in the control unit 200 are realized.

In the following description, the units of the control unit 200 will be explained in detail in cases that the image drum cartridge 6*a* as the replacement component is attached to the printer 1 as the image forming apparatus according to the second embodiment, and that the apparatus number of the image forming apparatus belonging to a same group is registered in the image forming apparatus according to the second embodiment.

In the embodiment, the control unit 200 includes a first comparison unit 213. In the case that the image drum cartridge 6*a* as the replacement component is attached to the printer 1 as the image forming apparatus according to the second embodiment, the first comparison unit 213 is provided for determining whether the image drum cartridge 6*a* as the replacement component is attached to the image forming apparatus in which the image drum cartridge 6*a* is allowed to use. More specifically, the first comparison unit 213 is provided for comparing the apparatus number stored in the RFID tag 6*b* (in the apparatus number column 18*c*) received from the RFID control unit 111 with the apparatus number (in the apparatus number column 19*a*) and the common group apparatus number (in the common group apparatus number column 19*b*) stored in the first comparison unit 213. Then, the first comparison unit 213 transmits a comparison result to the determining unit 116.

In the embodiment, when the apparatus number (in the apparatus number column 18*c*) matches to one of the apparatus number (in the apparatus number column 19*a*) and the common group apparatus number (in the common group apparatus number column 19*b*), the comparison result of the first comparison unit 213 is transmitted as matched. Only when the apparatus number (in the apparatus number column 18*c*) does not match to both of the apparatus number (in the apparatus number column 19*a*) and the common group apparatus number (in the common group apparatus number column 19*b*), the comparison result of the first comparison unit 213 is transmitted as not matched.

In the embodiment, the control unit 200 includes an operation control unit 212. In the case that the apparatus number of the image forming apparatus belonging to the same group is registered in the image forming apparatus, the operation control unit 212 displays a screen for prompting the input of the apparatus number on the operation panel 12*a*. When the administrator inputs the apparatus number of the image forming apparatus belonging to the same group, the operation control unit 212 stores the apparatus number in the common group apparatus number column 19*b* of the storage unit 23.

In the case that the apparatus number of the image forming apparatus belonging to the same group is registered in the image forming apparatus according to the second embodiment, it is necessary for the administrator to register the apparatus number of the printer belonging to the same group in the printer 1 in advance. The operation of registering the apparatus number of the printer belonging to the same group in the printer 1 in advance corresponds to the function that the apparatus number of the image forming apparatus belonging to the same group is registered in the image forming apparatus according to the second embodiment.

In the embodiment, before the image drum cartridge 6*a* as the replacement component is attached to the printer 1, the administrator inputs the apparatus number of the printer belonging to the same group into the printer 1 through the operation panel 12. When the administrator inputs the apparatus number, the operation control unit 212 writes the apparatus number thus input into the common group apparatus number column 19*b* of the storage unit 23. Accordingly, the operation of registering the apparatus number of the printer belonging to the same group in the printer 1 in advance is completed.

Figure 11:
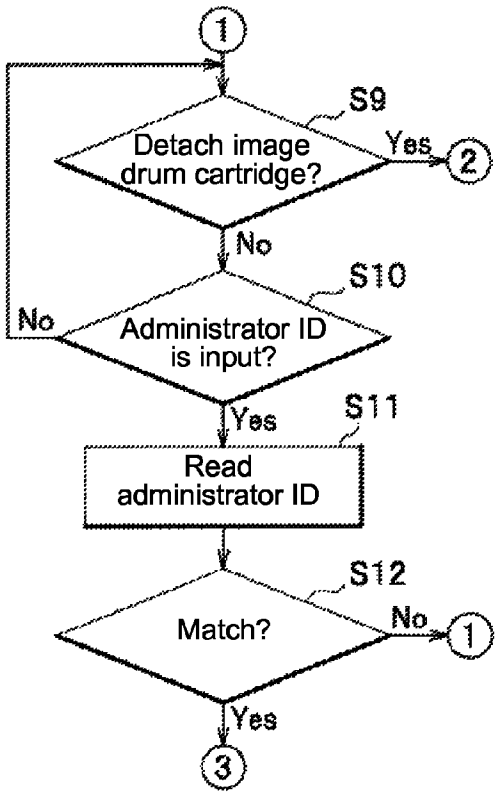
FIG. 11 is a flow chart showing an operation of the image forming apparatus when a replacement component is attached to the image forming apparatus according to the second embodiment of the present invention.
Figure 11:
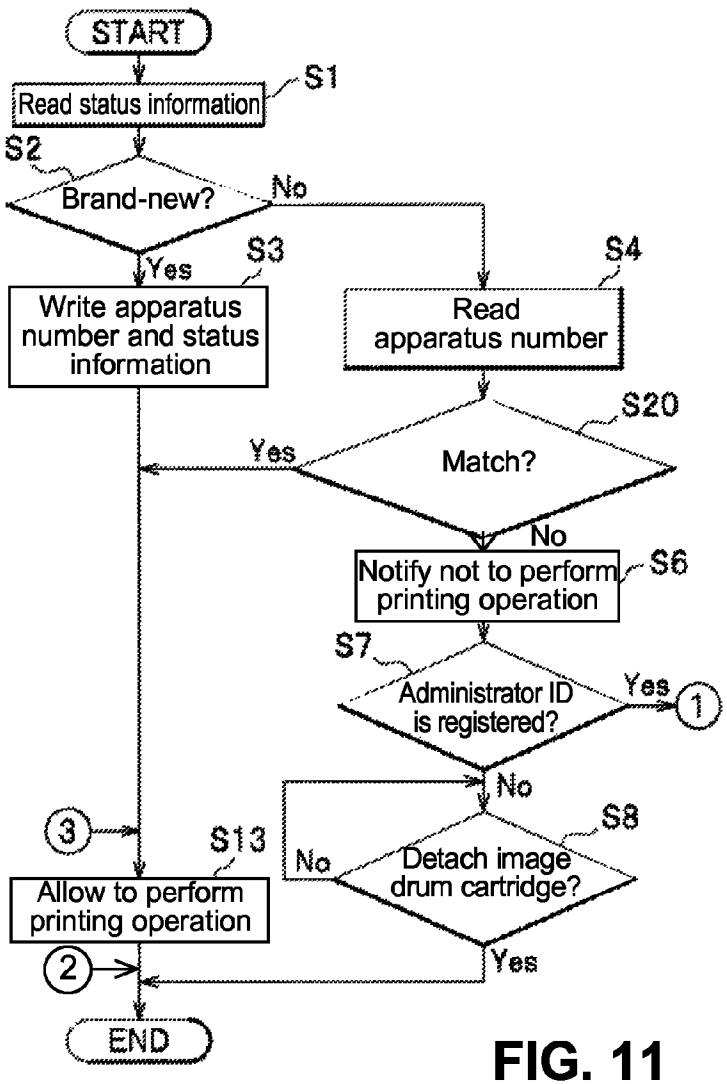

An operation of the printer 1 when a replacement component is attached to the printer 1 will be explained next with reference to FIG. 11. FIG. 11 is a flow chart showing the operation of the image forming apparatus when the replacement component is attached to the image forming apparatus according to the second embodiment of the present invention. In the following description, only a difference from the operation shown in FIG. 7 will be explained. More specifically, step S20 in the second embodiment shown in FIG. 11 is different from step S5 in the first embodiment shown in FIG. 7.

In step S20, the first comparison unit 213 compares the apparatus number (in the apparatus number column 18*c*) received from the RFID control unit 111 in step S4 with the apparatus number (in the apparatus number column 19*a*) and the common group apparatus number (in the common group apparatus number column 19*b*) stored in the storage unit 23. Then, the first comparison unit 213 transmits the comparison result to the determining unit 116. As described above, when the apparatus number (in the apparatus number column 18*c*) matches to one of the apparatus number (in the apparatus number column 19*a*) and the common group apparatus number (in the common group apparatus number column 19*b*), the comparison result of the first comparison unit 213 is transmitted as matched. When the determining unit 116 determines that the comparison result is matched, the process proceeds to step S13. When the determining unit 116 determines that the comparison result is not matched, the process proceeds to step S6.

As described above, in the image forming apparatus in the second embodiment, it is possible to register the apparatus number of the image forming apparatus belonging to the same group. Accordingly, in addition to the effect in the first embodiment, it is possible for an ordinary operator to use the replacement component in the image forming apparatus in the same group without inputting the administrator ID. When the apparatus number is not registered, the image forming apparatus cannot be used. Accordingly, it is possible to prevent the replacement component from being carried in from outside the group, or being carried out of the group.

Third Embodiment

A third embodiment of the present invention will be explained next. In the second embodiment, it is necessary for the administrator to register the apparatus number of the image forming apparatus belonging to the same group in advance. In the third embodiment, it is configured such that a group identification marker is attached to the image forming apparatus, so that the group identification marker is registered, instead of the apparatus number of the image forming apparatus belonging to the same group. Accordingly, it is possible to eliminate the step of registering a plurality of apparatus numbers.

Figure 12:
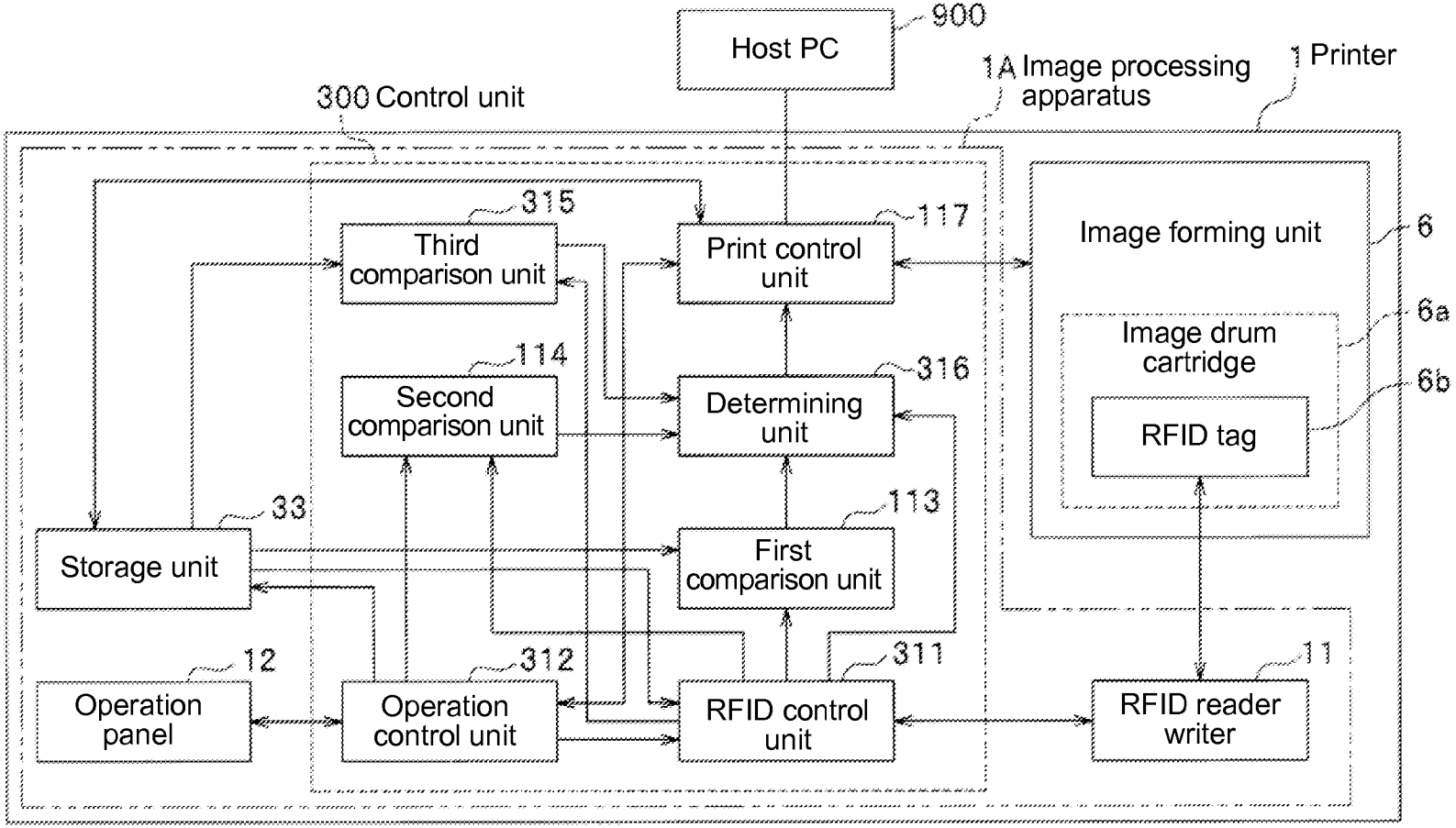
FIG. 12 is a block diagram showing functional components of an image forming apparatus according to a third embodiment of the present invention.

FIG. 12 is a block diagram showing functional components of the image forming apparatus according to the third embodiment of the present invention. FIG. 13 is a schematic view showing a data configuration of the image forming apparatus according to the third embodiment of the present invention. FIG. 14 is a schematic view showing a data configuration of the RFID tag 6*b* of the image forming apparatus according to the third embodiment of the present invention.

In the following description, a data configuration of a storage unit 33 and the data configuration of the RFID tag 6*b* will be explained first with reference to FIGS. 13 and 14. Then, the functional components of the printer 1 as the image forming apparatus will be explained with reference to FIG. 12. Components in the third embodiment similar to those in the first embodiment are designated with the same reference numerals, and only components in the third embodiment different from those in the first embodiment will be explained.

As described above, FIG. 13 is a schematic view showing the data configuration of the storage unit 33. As shown in FIG. 13, the data configuration of the storage unit 33 includes the apparatus number column 19*a*, and information similar to that in the first embodiment is stored in the apparatus number column 19*a*. Further, the data configuration of the storage unit 23 includes a group identification mark column 19*c*, and the group identification mark of a group to which the printer 1 belongs is stored in the group identification mark column 19*c* as self group identification information. It is possible to use a serial number input by the administrator as the group identification mark in the group identification mark column 19*c*. It is noted that a same group identification mark is assigned to the image forming apparatus belonging to a same group.

FIG. 14 is a schematic view showing a data configuration of the RFID tag 6*b*. As shown in FIG. 14, the data configuration of the RFID tag 6*b* includes the status information column 18*a*, the unit number column 18*b*, the apparatus number column 18*c*, and the administrator ID column 18*d*. In the embodiment, information similar to that in the first embodiment is stored in the status information column 18*a*, the unit number column 18*b*, the apparatus number column 18*c*, and the administrator ID column 18*d*.

In the embodiment, the RFID tag 6*b* further includes a group information column 18*e* for storing group information of the printer 1, and a group identification mark column 18*f*. The group information in the group information column 18*e* is assigned with "0" or "1". More specifically, when the group identification mark is not registered in the group identification mark column 18*f*, the group information in the group information column 18*e* is assigned with "0". When the group identification mark is registered in the group identification mark column 18*f*, the group information in the group information column 18*e* is assigned with "1".

In the embodiment, the group identification mark column 18*f* is provided for storing the group identification mark as the group identification information of the group to which the printer 1 belongs. The group identification mark in the group identification mark column 18*f* has a data format the same as that of the group identification mark stored in the group identification mark column 19*c* of the storage unit 33.

As described above, FIG. 12 is a block diagram showing the functional components of the printer 1 as the image forming apparatus according to the third embodiment of the present invention. As shown in FIG. 12, the printer 1 includes a control unit 300. When a microprocessor of the control unit 300 (not shown) executes a control program stored in the storage unit 33, functions of units disposed in the control unit 300 are realized.

In the following description, the units of the control unit 300 will be explained in detail in cases that the image drum cartridge 6*a* as the replacement component is attached to the printer 1 as the image forming apparatus according to the third embodiment, and that the group identification mark is registered in the image forming apparatus according to the third embodiment or the replacement component.

In the embodiment, the control unit 300 includes an RFID control unit 311, a third comparison unit 315 and a determining unit 316. In addition to the function of the RFID control unit 111 in the first embodiment, when it is determined whether the group identification mark is identical, the RFID control unit 311 is provided for transmitting the group information in the group information column 18*e* to the determining unit 316, and transmitting the group identification mark in the group identification mark column 18*f* to the third comparison unit 315.

In the embodiment, the third comparison unit 315 is provided for determining whether the image drum cartridge 6*a* as the replacement component is attached to the image forming apparatus in the group in which the image drum cartridge 6*a* is allowed to use. More specifically, the third comparison unit 315 is provided for comparing the group identification mark stored in the RFID tag 6*b* (in the group identification mark column 18*f*) received from the RFID control unit 311 with the group identification mark stored in the storage unit 33 (in the group identification mark column 19*c*). Then, the third comparison unit 315 transmits a comparison result to the determining unit 316.

In the embodiment, in addition to the function of the determining unit 116 in the first embodiment, the determining unit 316 is provided for determining whether the print control unit 117 is allowed to perform the printing operation according to the comparison result of the third comparison unit 315. Then, the determining unit 316 transmits a determination result to the print control unit 117.

More specifically, when the status information stored in the RFID tag 6*b* (in the status information column 18*a*) is "00" or "11", the comparison result received from the first comparison unit 113 is not matched, and the comparison result received from the third comparison unit 315 is matched, the determining unit 116 allows the print control unit 117 to perform the printing operation. Otherwise, the determining unit 116 does not allow the print control unit 117 to perform the printing operation.

In the embodiment, the control unit 300 includes an operation control unit 312. The operation control unit 312 is provided for displaying a screen for prompting the input of the group identification mark on the operation panel 12*a*. When the administrator inputs the group identification mark, the operation control unit 312 stores the group identification mark in the group identification mark column 19*c* of the storage unit 33 and in the group identification mark column 18*f* of the RFID tag 6*b*. Further, the operation control unit 312 is provided for storing "1" in the group information column 18*e*.

In the case that the group identification mark is registered in the image forming apparatus according to the third embodiment or the replacement component, it is necessary for the administrator to register the group identification mark in the printer 1 or the replacement component in advance. The operation of registering the group identification mark in the printer 1 or the replacement component in advance corresponds to the function that the group identification mark is registered in the image forming apparatus according to the second embodiment or the replacement component.

In the embodiment, before the image drum cartridge 6*a* as the replacement component is attached to the printer 1, the administrator inputs the group identification mark of the group of the printer 1 into the printer 1 through the operation panel 12. When the administrator inputs the group identification mark, the operation control unit 312 writes the group identification mark thus input into the group identification mark column 19*c* of the storage unit 33.

Further, in the state that the image drum cartridge 6*a* is attached to the printer 1, the administrator inputs the group identification mark of the group in which the image drum cartridge 6*a* can be used into the image drum cartridge 6*a* through the operation panel 12. When the administrator inputs the group identification mark, the operation control unit 312 writes the group identification mark thus input into the group identification mark column 18*f* of the RFID tag 6*b*. Further, the operation control unit 312 writes "1" into the group information column 18*e*. Accordingly, the operation of registering the group identification mark in advance is completed.

Figure 15:
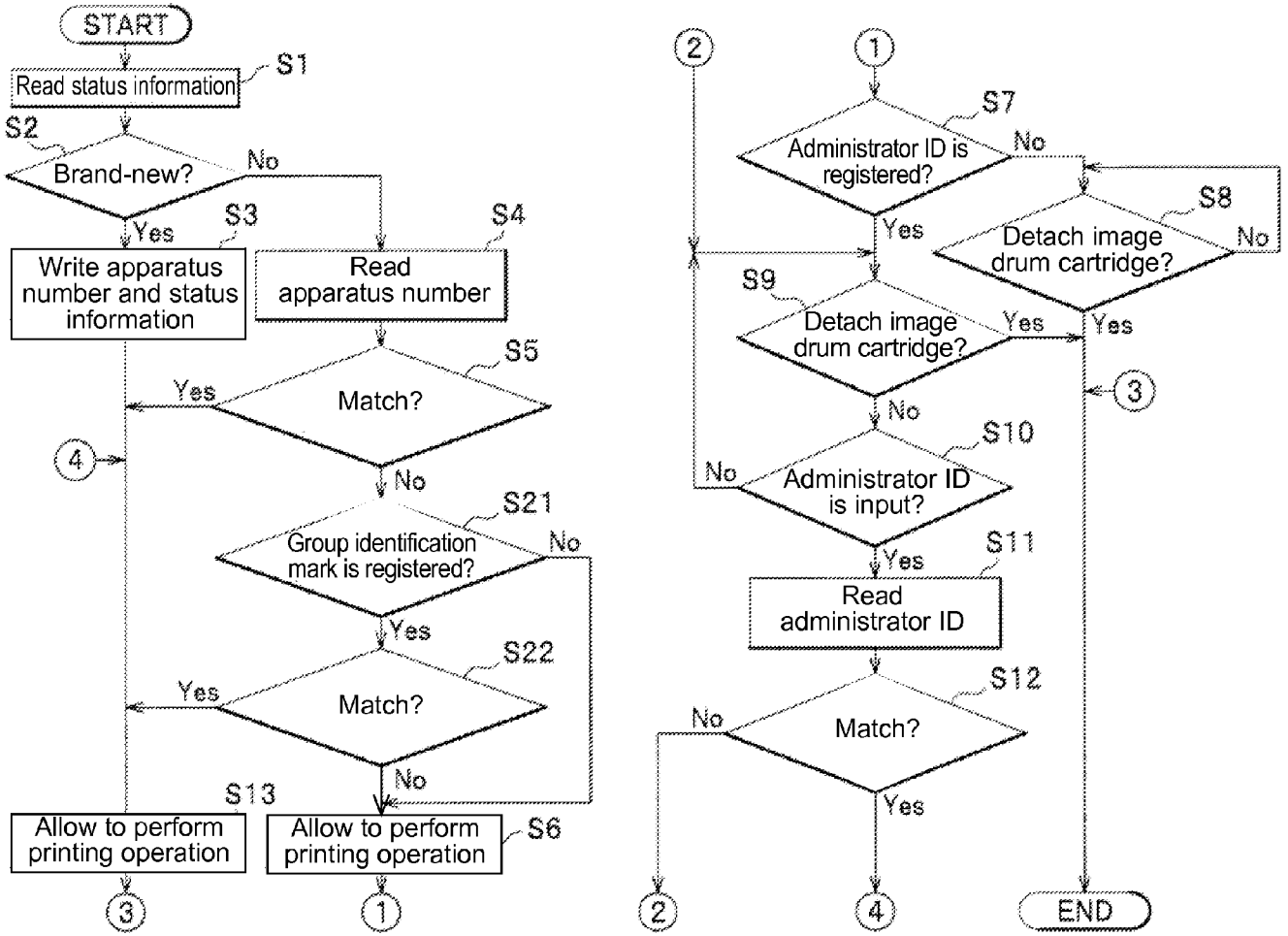
FIG. 15 is a flow chart showing an operation of the image forming apparatus when a replacement component is attached to the image forming apparatus according to the third embodiment of the present invention.

An operation of the printer 1 when the replacement component is attached to the printer 1 will be explained next with reference to FIG. 15. FIG. 15 is a flow chart showing the operation of the image forming apparatus when the replacement component is attached to the image forming apparatus according to the third embodiment of the present invention. In the following description, only a difference from the operation shown in FIG. 7 will be explained. More specifically, step S21 and step S22 in the third embodiment shown in FIG. 15 are different from the first embodiment shown in FIG. 7.

In step S21, when the determining unit 316 determines that the comparison result is not matched (step S5, No), the RFID control unit 311 retrieves the group information stored in the RFID tag 6*b* (in the group information column 18*e*), and transmits the group information to the determining unit 316. When the group information (in the group information column 18*e*) is "1", the determining unit 316 determines that the group identification mark is registered in the image drum cartridge 6*a*, and the process proceeds to step S22. When the group information (in the group information column 18*e*) is "0", the determining unit 316 determines that the group identification mark is not registered in the image drum cartridge 6*a*, and the process proceeds to step S6.

In step S22, when the determining unit 316 determines that the comparison result is registered (step S21, Yes), the RFID control unit 311 retrieves the group identification mark stored in the RFID tag 6*b* (in the group identification mark column 18*f*), and transmits the group identification mark to the third comparison unit 315. When the third comparison unit 315 receives the group identification mark, the third comparison unit 315 compares the group identification mark (in the group identification mark column 18*f*) received from the RFID control unit 311 with the group identification mark stored in the storage unit 33 (in the group identification mark column 19*c*). Then, the third comparison unit 315 transmits a comparison result to the determining unit 316. When the determining unit 316 determines that the comparison result is matched, the process proceeds to step S13. When the determining unit 316 determines that the comparison result is not matched, the process proceeds to step S6.

As described above, in the image forming apparatus in the third embodiment, it is possible to register the group identification mark. Accordingly, it is possible to obtain the effect the same as that in the second embodiment with a storage capacity smaller than that of the image forming apparatus in the second embodiment.

Modified Example

In the first to third embodiments described above, the printer 1 is explained as the image forming apparatus, and the present invention is not limited thereto. The present invention may be applicable to an image forming apparatus such as a facsimile, a copier, a scanner, and a multi function peripheral or product (MFP) having a printer unit and a scanning unit.

Figure 16:
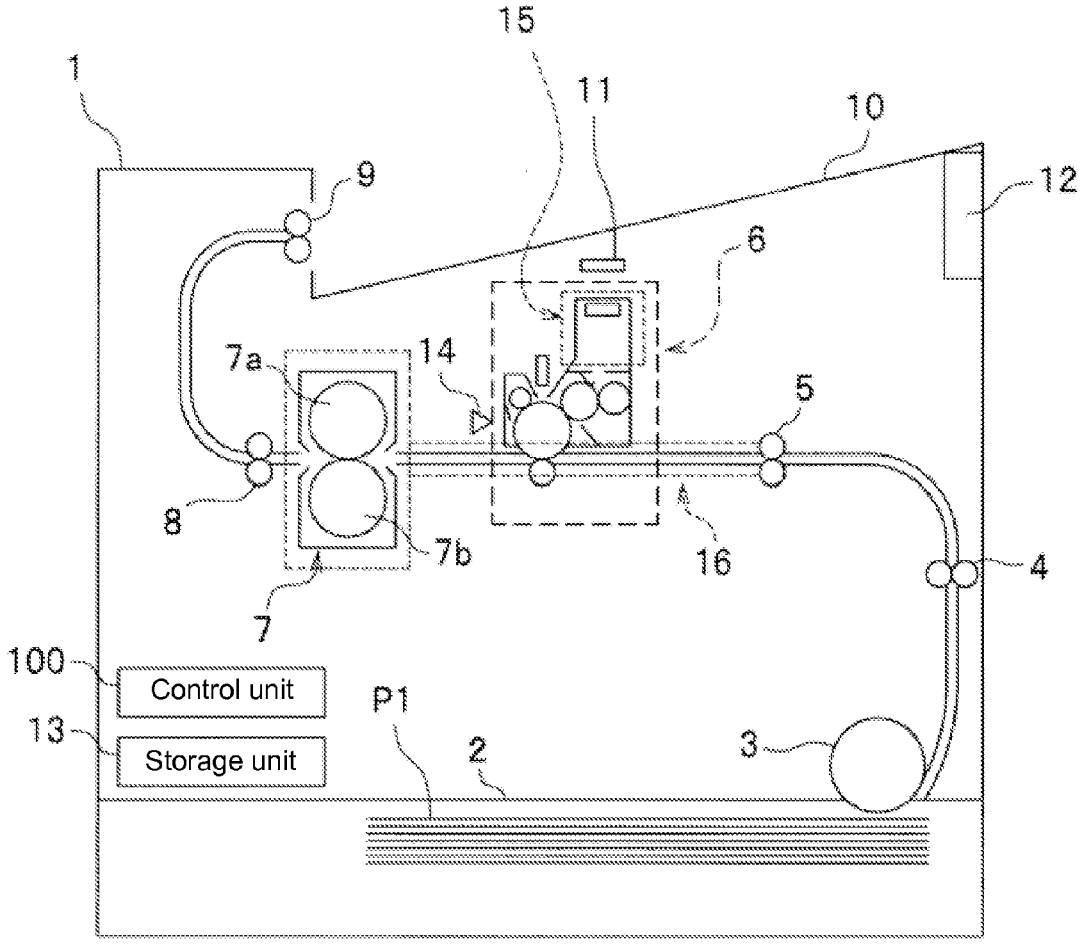
FIG. 16 is a schematic view showing a modified example of the replacement component according to the present invention.

Further, in the first to third embodiments described above, the case that the image drum cartridge 6*a* (refer to FIG. 2) is attached to the printer 1 as the replacement component is explained, and the present invention is not limited thereto. FIG. 16 is a schematic view showing a modified example of the replacement component according to the present invention.

As shown in FIG. 16, for example, when the fixing unit 7 is configured to be exchangeable, it is possible to apply the embodiments to the fixing unit 7 as the replacement component. Further, when the toner storage portion 6*c* of the image drum cartridge 6*a* is configured to be a toner cartridge 15 and exchangeable, it is possible to apply the embodiments to the toner cartridge 15 as the replacement component. Further, when a belt unit 16 is configured to be exchangeable, it is possible to apply the embodiments to the belt unit 16 as the replacement component. Still further, the photosensitive drum can be the replacement component.

When the printer 1 is an ink jet printer, an ink cartridge can be the replacement component. When the image forming apparatus is a copier, various types of components can be the replacement component. In other words, when components of the image forming apparatus are exchangeable, it is possible to apply the embodiments to the components as the replacement component. In this case, the RFID tag 6*b* is attached to the exchangeable component, and the RFID reader writer 11 is disposed within a range capable of communicating with the RFID tag 6*b*.

When a plurality of replacement components is disposed in one image forming apparatus, it may be configured such that the RFID tag 6*b* is attached to each of the replacement components, and the RFID reader writer 11 communicates with the replacement components. In this case, information of each of the replacement components is stored in the storage unit 13, the storage unit 23, or the storage unit 33. Accordingly, the control unit 100, the control unit 200, or the control unit 300 is able to determine whether the printing operation is performed according to the information of each of the replacement components. In this case, an anti-collision technology such as a time slot method may be applied, so that the RFID reader writer 11 is able to read the RFID tag 6*b* attached to each of the replacement components.

Further, in the first to third embodiments described above, the operation panel 12 includes the operation button 12*b* as shown in FIG. 3, so that the administrator can input the administrator ID and the like through the operation button 12*b*. The present invention is not limited thereto. For example, a reading device may be disposed on the operation panel 12 of the printer 1 for reading a magnetic card, a non-contact communication card, and the like, thereby reading data inside the card. As far as the image forming apparatus is provided with a device for inputting information, various devices may be applicable instead of the operation button 12*b*.

The disclosure of Japanese Patent Application No. 2009-269757, filed on Nov. 27, 2009, is incorporated in the application.

While the invention has been explained with reference to the specific embodiments of the invention, the explanation is illustrative and the invention is limited only by the appended claims.

What is claimed is:

1. An image processing apparatus capable of using a replacement component, comprising:

a storage unit for storing self apparatus identification information;

an obtaining unit for obtaining component apparatus identification information and component administrator identification information registered in a data carrier disposed in the replacement component;

an input unit for inputting self administrator identification information;

a control unit including a first comparing unit for comparing the self apparatus identification information stored in the storage unit with the component apparatus identification information obtained with the obtaining unit, said control unit further including a second comparing unit for comparing the self administrator identification information input through the input unit with the component administrator identification information obtained with the obtaining unit; and a determining unit for determining that the replacement component is allowed to use when the self apparatus identification information matches the component apparatus identification information, wherein said control unit is configured to write the self apparatus identification information in the data carrier as the component apparatus identification information when the replacement component is attached to the image processing apparatus, said determining unit is configured to determine that the replacement component is allowed to use when the component apparatus identification information is not registered in the data carrier, said determining unit is configured to determine that the replacement component is not allowed to use when the self apparatus identification information does not match the component apparatus identification information, said control unit is configured to make the self administrator identification information be input through the input unit when the self apparatus identification information does not match the component apparatus identification information, and the component administrator identification information is registered in the data carrier, and said determining unit is configured to determine that the replacement component is allowed to use when the self administrator identification information is input through the input unit, and the self administrator identification information matches the component administrator identification information.

2. The image processing apparatus according to claim 1, wherein said determining unit is arranged to determine that the replacement component is allowed to use when the self administrator identification information matches the component administrator identification information even though the self apparatus identification information does not match the component apparatus identification information, and to determine that the replacement component is not allowed to use in other cases.

3. The image processing apparatus according to claim 2, wherein said storage unit is arranged to store other apparatus identification information, said first comparing unit being arranged to compare the self apparatus identification information or the other apparatus identification information with the component apparatus identification information, said determining unit being arranged to determine that the replacement component is allowed to use when the self apparatus identification information or the other apparatus identification information matches the component apparatus identification information, to determine that the replacement component is allowed to use when the self administrator identification information matches the component administrator identification information even though the self apparatus identification information or the other apparatus identification information does not match the component apparatus identification information, and to determine that the replacement component is not allowed to use in other cases.

4. The image processing apparatus according to claim 2, wherein said storage unit is arranged to store self group identification information, said obtaining unit being arranged to obtain component group identification information registered in the data carrier, said control unit including a third comparing unit for comparing the self group identification information with the component group identification information, said determining unit being arranged to determine that the replacement component is allowed to use when the self group identification information matches the component group identification information even though the self apparatus identification information or the other apparatus identification information does not match the component apparatus identification information, to determine that the replacement component is allowed to use when the self administrator identification information matches the component administrator identification information even though the self group identification information does not match the component group identification information and the self apparatus identification information or the other apparatus identification information does not match the component apparatus identification information, and to determine that the replacement component is not allowed to use in other cases.

5. The image processing apparatus according to claim 1, wherein said obtaining unit is arranged to obtain the component apparatus identification information registered in the data carrier in a non-contact way.

6. An image forming apparatus comprising the image processing apparatus according to claim 1, the replacement component, and an image forming unit for forming an image on a medium when the determining unit determines that the replacement component is allowed to use.

7. A method of using a replacement component of an image processing apparatus to be executed with a control unit of the image processing apparatus capable of using the replacement component, comprising the steps of:

storing self apparatus identification information in a storage unit;

obtaining component apparatus identification information and component administrator identification information registered in a data carrier disposed in the replacement component using an obtaining unit;

inputting self administrator identification information into an input unit;

comparing the self apparatus identification information stored in the storage unit with the component apparatus identification information obtained with the obtaining unit;

comparing the self administrator identification information input through the input unit with the component administrator identification information obtained with the obtaining unit;

writing the self apparatus identification information in the data carrier as the component apparatus identification information when the replacement component is attached to the image processing apparatus;

determining that the replacement component is allowed to use when the self apparatus identification information matches the component apparatus identification information;

determining that the replacement component is allowed to use when the component apparatus identification information is not registered in the data carrier;

determining that the replacement component is not allowed to use when the self apparatus identification information does not match the component apparatus identification information;

making the self administrator identification information be input through the input unit when the self apparatus identification information does not match the component apparatus identification information, and the component administrator identification information is registered in the data carrier; and determining that the replacement component is allowed to use when the self administrator identification information is input through the input unit, and the self administrator identification information matches the component administrator identification information.

8. The image processing apparatus according to claim 1, wherein said determining unit is configured to determine that the replacement component is allowed to use in other image processing apparatus when the component apparatus identification information is not registered in the data carrier.

9. The image processing apparatus according to claim 1, wherein said determining unit is configured to write the self apparatus identification information as the component apparatus identification information when the component apparatus identification information is not registered in the data carrier.

10. The image processing apparatus according to claim 1, wherein said storage unit is configured to store the self apparatus identification information as first specific information of the image processing apparatus, and said obtaining unit is configured to obtain the component apparatus identification information as second specific information of the image processing apparatus.

11. The method of using the replacement component according to claim 7, further comprising the step of determining that the replacement component is allowed to use in other image processing apparatus when the component apparatus identification information is not registered in the data carrier.

12. The method of using the replacement component according to claim 7, further comprising the step of writing the self apparatus identification information as the component apparatus identification information when the component apparatus identification information is not registered in the data carrier.

13. The method of using the replacement component according to claim 7, wherein, in the step of storing the self apparatus identification information, said self apparatus identification information is stored as first specific information of the image processing apparatus, and in the step of obtaining the component apparatus identification information, said component apparatus identification information is obtained as second specific information of the image processing apparatus.

14. The image processing apparatus according to claim 1, wherein said control unit is configured to write the self apparatus identification information in the data carrier as the component apparatus identification information when the component apparatus identification information is not stored in the data carrier.

15. The method of using the replacement component according to claim 7, wherein, in the step of writing the self apparatus identification information in the data carrier, said self apparatus identification information is written in the data carrier as the component apparatus identification information when the component apparatus identification information is not stored in the data carrier.

* * * * *